US006470514B2

(12) United States Patent
Onoue

(10) Patent No.: US 6,470,514 B2
(45) Date of Patent: Oct. 29, 2002

(54) DRAIN VALVE

(75) Inventor: Hiroyasu Onoue, Tokyo (JP)

(73) Assignee: Jamco Corporation, Tokyo (JP)

( * ) Notice: Subject to any disclaimer, the term of this patent is extended or adjusted under 35 U.S.C. 154(b) by 0 days.

(21) Appl. No.: 09/855,513

(22) Filed: May 16, 2001

(65) Prior Publication Data

US 2001/0052150 A1 Dec. 20, 2001

(30) Foreign Application Priority Data

Jun. 19, 2000 (JP) ..... 2000-182800

(51) Int. Cl.[7] ..... E03C 1/23
(52) U.S. Cl. ..... 4/691; 4/688
(58) Field of Search ..... 4/684, 685, 689, 4/690, 691, 692

(56) References Cited

U.S. PATENT DOCUMENTS 1,647,188 A * 11/1927 Mueller et al. ..... 4/692
1,723,038 A * 8/1929 Hoelscher ..... 4/692
2,524,723 A * 10/1950 Young ..... 4/692
2,807,806 A * 10/1957 Watkins ..... 4/692

FOREIGN PATENT DOCUMENTS

GB 1217239 * 12/1970 ..... 4/691
JP 109868 * 8/1980 ..... 4/689

* cited by examiner

*Primary Examiner*—Robert M. Fetsuga
(74) *Attorney, Agent, or Firm*—Armstrong, Westerman & Hattori, LLP

(57) ABSTRACT

A drain valve 1 comprises a body 10 having a cylinder portion 11 and a branch portion 12, to which are mounted a plug 30 constituting a valve seat and a hose joint 70. A poppet 50 constituting a valve means is slidably inserted to the plug 30. An operating device 100 mounted to said branch portion 12 and comprising a movable shaft 120 is used to open and close the valve by operating said poppet 50 via an operating rod 160.

8 Claims, 10 Drawing Sheets

Fig. 2
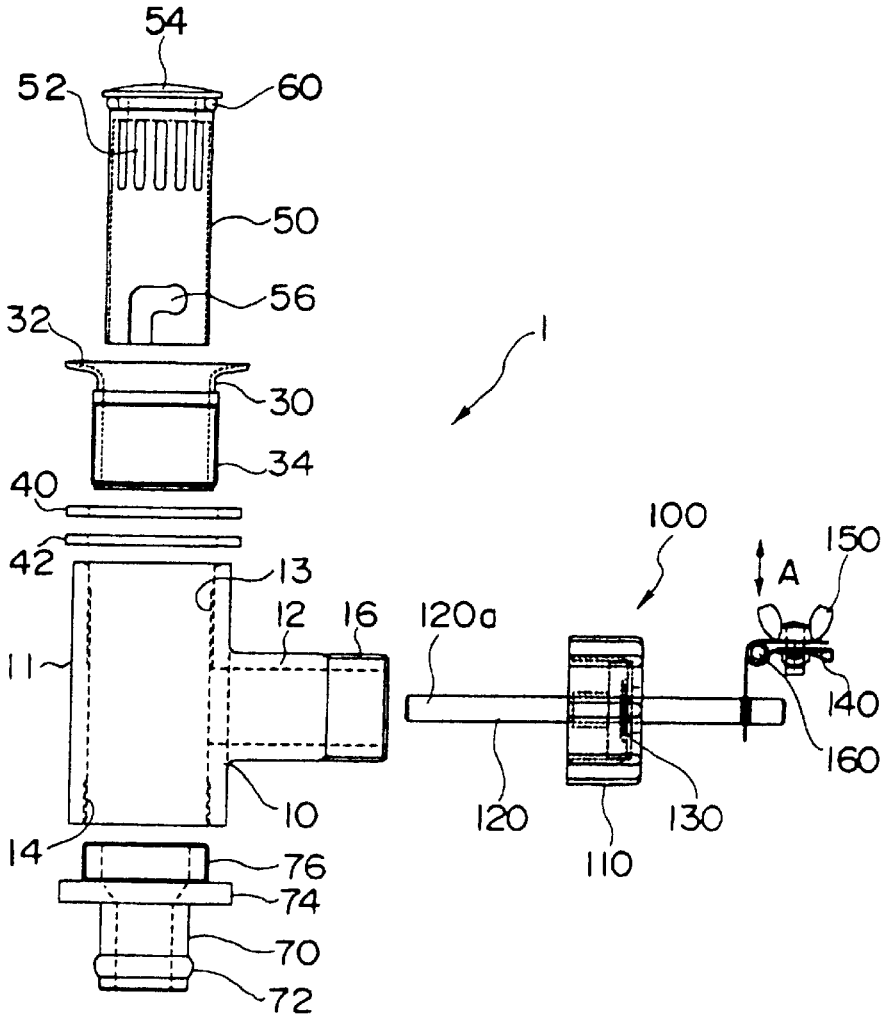
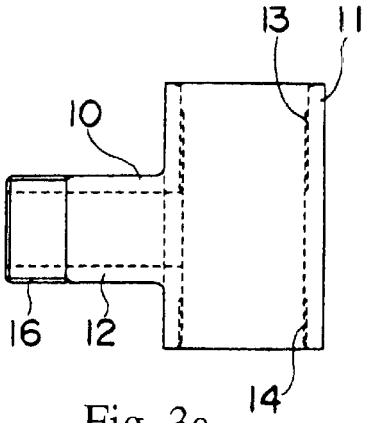
Fig. 3a
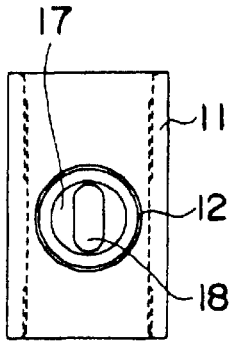
Fig. 3b
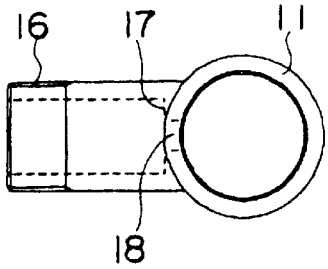
Fig. 3c

Fig.14
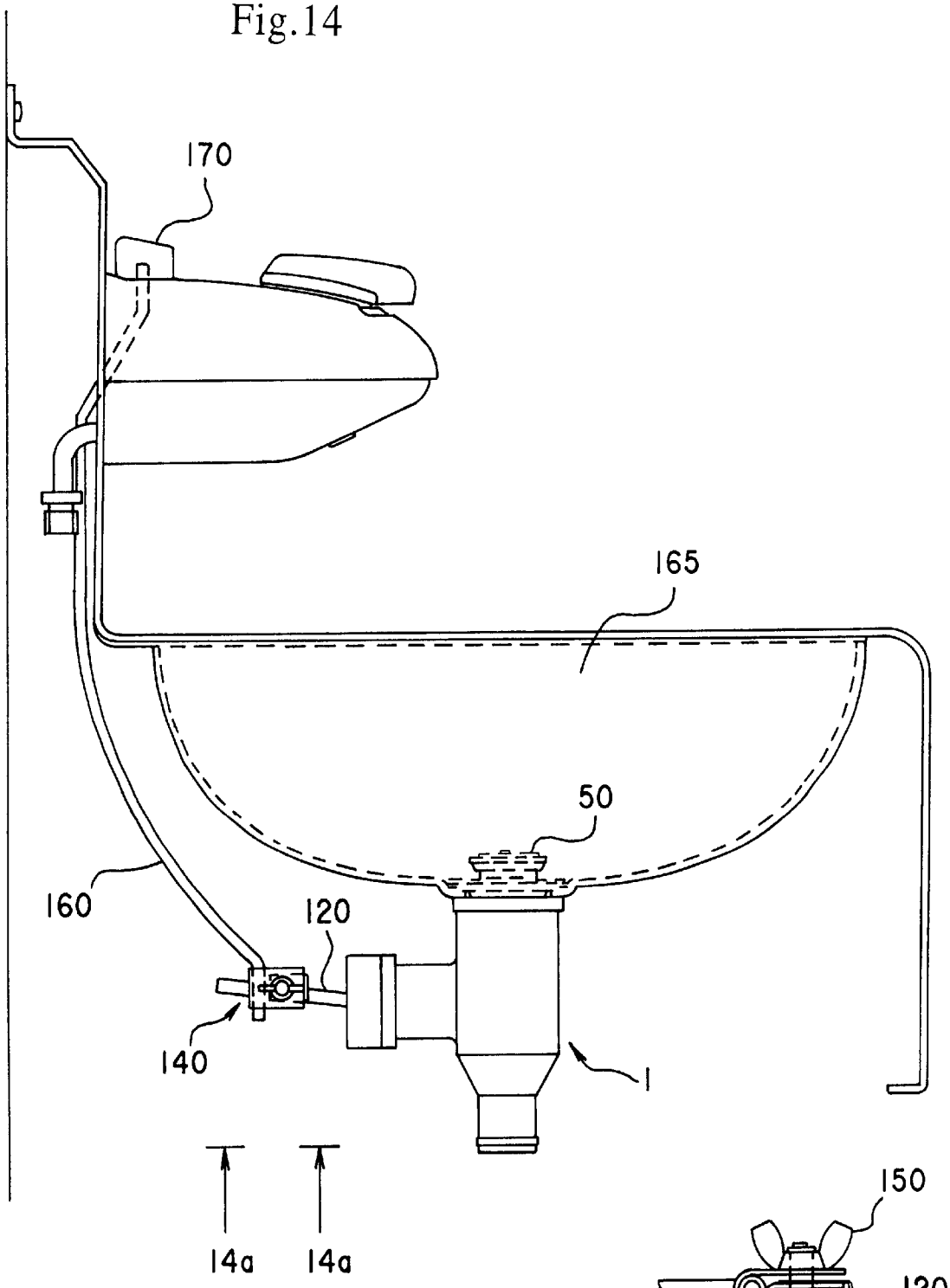
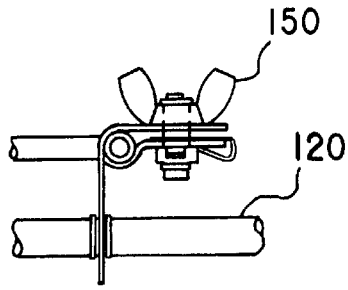
Fig.14a

DRAIN VALVE

FIELD OF THE INVENTION

The present invention relates to a drain valve mounted to the bottom area of a bowl in a washbasin for controlling the impounding and draining of water in the bowl.

DESCRIPTION OF THE RELATED ART

The drain valve equipped to the bottom area of a bowl constituting a washbasin is operated through a lever and the like equipped on top of the washbasin and connected thereto.

This type of drain valve is equipped with a means that prevents water from leaking, and must be designed so as not to cause any malfunction.

SUMMARY OF THE INVENTION

Especially in a drain valve equipped in a lavatory unit on an aircraft, negative pressure is applied to the drain pipe (waste pipe), and there is a need to open the valve resisting to the negative pressure, which requires secure operation. Moreover, since many passengers use the drain vale, there is stronger need for a structure that will not cause any malfunction.

Even further, it is required that the design of the drain valve allows fixture and maintenance of the drain valve to be performed within a limited space.

The present invention provides a drain valve that fulfills all the above requirements.

The drain valve mounted to the bottom area of a bowl in a washbasin comprises, as basic means, a body having a cylinder portion and a branch portion arranged orthogonal to the cylinder portion, a plug mounted to one end of the cylinder portion of the body and constituting a valve seat, a poppet slidably inserted to the plug and constituting a valve means, a hose joint mounted to the other end of the cylinder portion of the body, and an operating device mounted to the branch portion of the body for operating the poppet.

The poppet constituting the valve means has a pipe-like structure with one end being opened, comprising a valve portion formed to the end not being opened, a plural number of slits formed to the pipe portion, and a fixing groove formed to the opened end thereof to which is connected the operating device.

Moreover, the operating device of the poppet constituting the valve means comprises a bracket fixed to the branch portion of said body, a shaft penetrated through the bracket and movably supported by the bracket, and a link member mounted to one end of the shaft, wherein a rod member fixed to the link member is connected to an operating means equipped to the washbasin, and the other end of the shaft is connected to the groove of the poppet.

BRIEF DESCRIPTION OF THE DRAWINGS

FIG. 2 shows the parts of the drain valve according to the invention;

FIG. 3 is an explanatory view of the body of the drain valve according to the invention;

FIG. 14 is a side view of an embodiment of the present invention mounted on a common wash basin;

FIG. 14*a* shows a detail of the embodiment of FIG. 14.

DETAILED DESCRIPTION OF PREFERRED EMBODIMENTS

Figure 1:
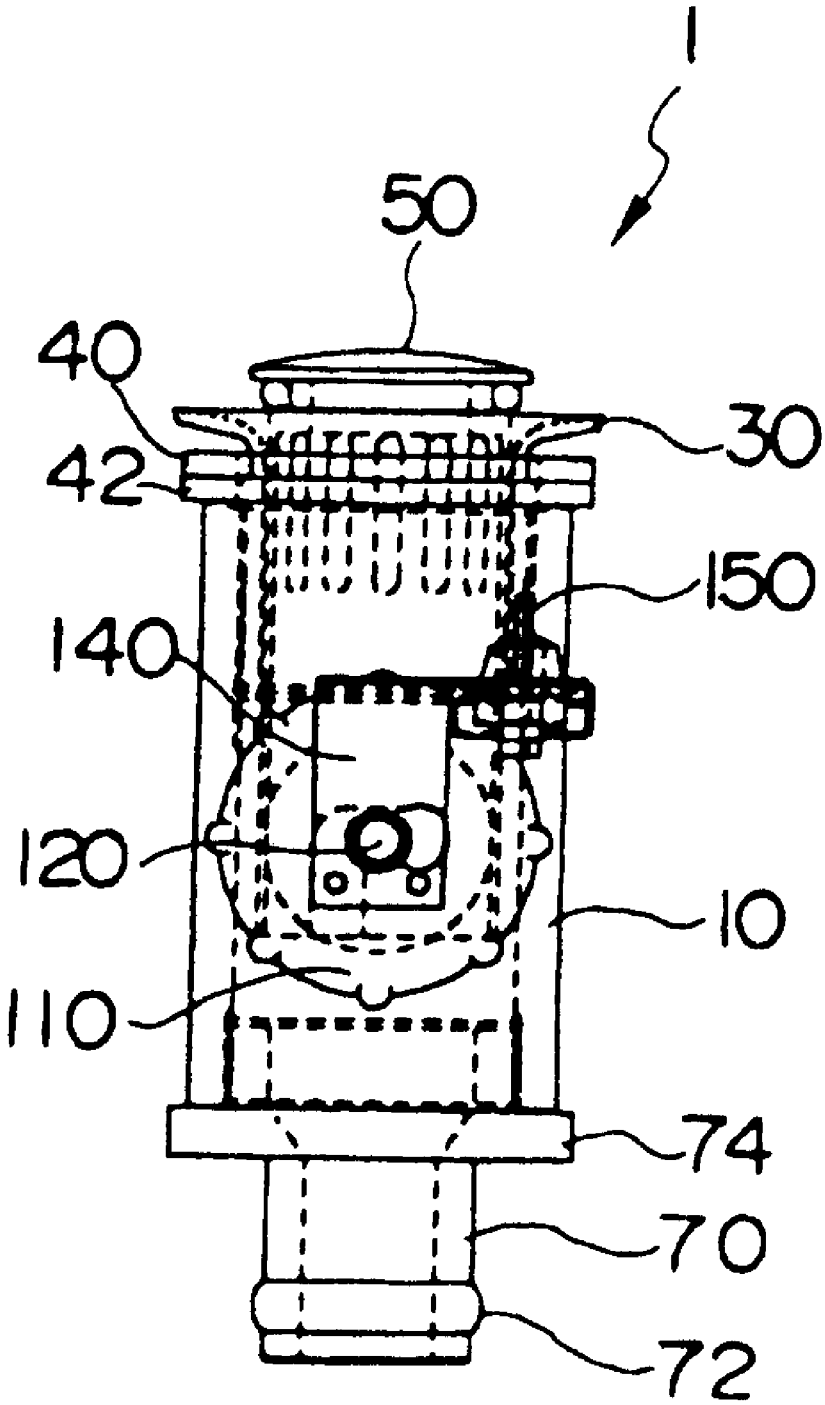
FIG. 1 is a side view of the drain valve according to the present invention.

FIG. 1 is a side view showing the assembly structure of the drain valve according to the present invention, and FIG. 2 is a view showing the structure of the parts.

The drain valve shown as a whole by reference number 1 comprises a body 10. The body 10 is formed in the shape of the letter T, with a cylinder portion 11 and a branch portion 12 positioned orthogonal to the cylinder portion 11, which is formed for example by shaping a synthetic resin material.

FIG. 3 is an explanatory view showing the details of body 10.

The body 10 has inner screw portions 13 and 14 formed respectively on both end portions of the cylinder portion 11. At the end of the branch portion 12 is formed an external screw portion 16. At the inner bottom portion 17 of the branch portion 12 formed to the junction between the cylinder portion 11 is formed a vertical long slit 18.

Figure 4A:
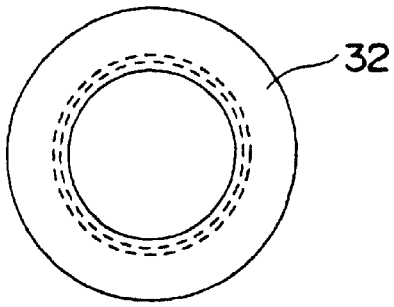
FIG. 4 is an explanatory view showing the plug of the drain valve according to the present invention.
Figure 4B:
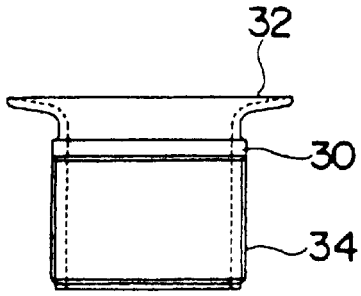

A plug 30 functioning as a valve seat is screwed onto the first inner screw portion 13 of the cylinder portion 11. As shown in FIG. 4, the plug 30 is a cylinder member comprising an external screw portion 34 and an outwardly curved valve seat 32, which is to be mounted onto the body 10 via two rubber packings 40 and 42. The plug 30 is made for example of brass. The number of packings is not limited to two, and only one packing can be used.

Figure 5A:
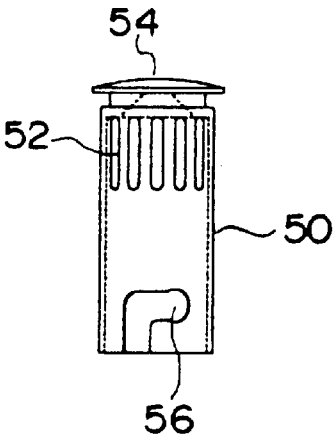
FIG. 5 is an explanatory view showing the poppet of the drain valve according to the present invention.
Figure 5B:
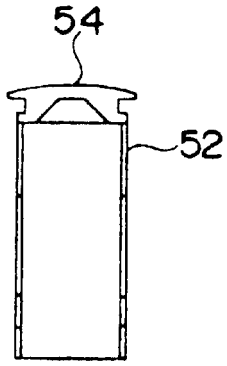

A valve body 50 called a poppet is inserted to the plug 30 so as to slide freely therein. As shown in FIG. 5, the poppet 50 comprises a valve portion 54 at the upper area thereof, and a pipe-like body opening toward the bottom, with plurality of long slits 52 formed below the valve portion 54.

A fixing groove 56 for receiving the shaft that drives the poppet 50 in the vertical direction is formed to the lower end opening of the poppet 50.

When the poppet 50 descends and the valve portion 54 contacts the valve seat 32 of the plug 30, the drain valve 1 is closed, and water is maintained within the bowl having the drain valve 1.

In order to improve the sealing performance between the valve portion 54 of the poppet 50 and the valve seat 32, an o-ring 60 is mounted under the valve portion 54.

Figure 6A:
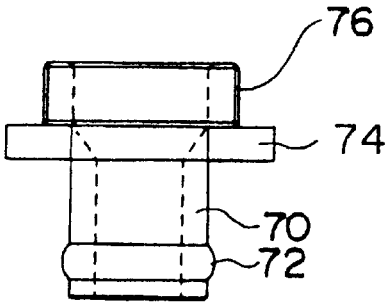
FIG. 6 is an explanatory view showing the hose joint of the drain valve according to the invention.
Figure 6B:
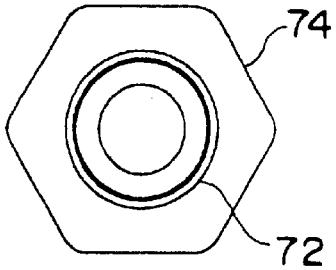

A hose joint 70 is screwed onto the second inner screw portion 14 of the body 10. As shown in FIG. 6, the hose joint 70 comprises an external screw portion 76 to be screwed onto the second inner screw portion of the body and a nut portion 74, which is screwed onto position using the nut portion 74. A protrusion 72 is formed to the lower end of the hose joint 70, which secures the mounting of the hose.

An operating device 100 for operating the poppet 50 is mounted to the branch portion 12 of the body 10 of the drain valve 1.

Figure 7A:
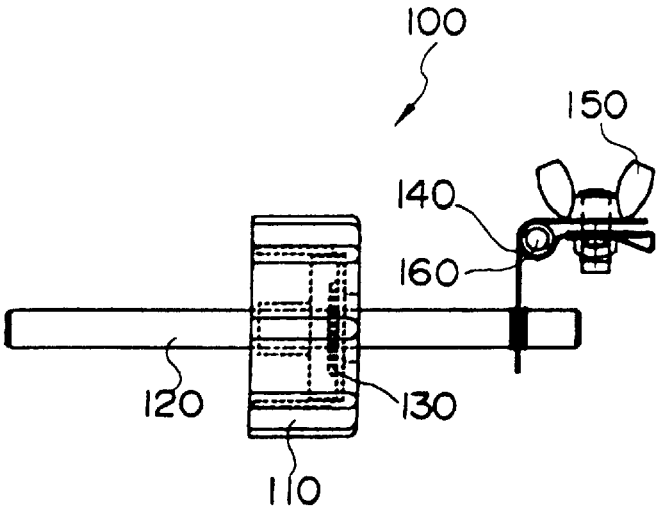
FIG. 7 is an explanatory view showing the operating device of the drain valve according to the invention.
Figure 7B:
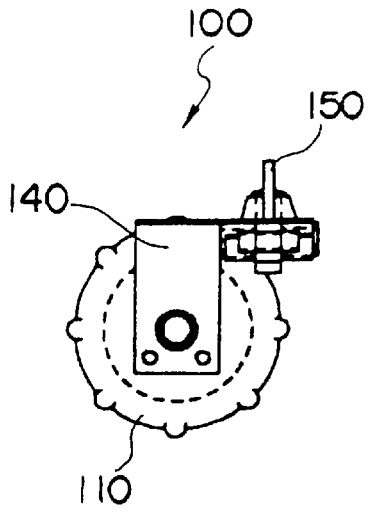
Figure 8:
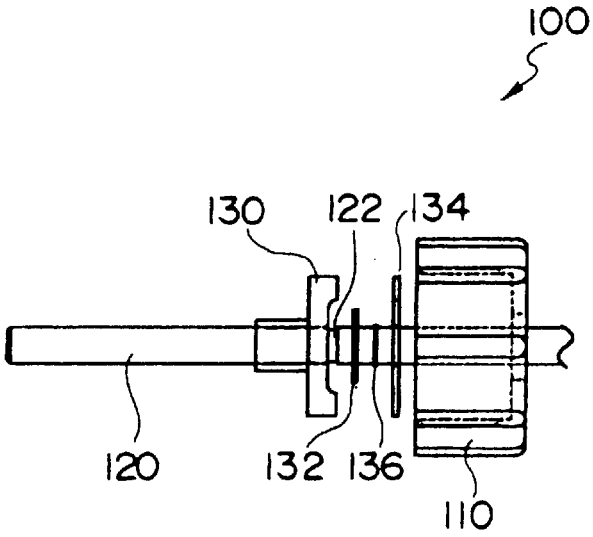
FIG. 8 shows the parts of the operating device of the drain valve according to the invention.

FIG. 7 is an assembly diagram showing the operating device, and FIG. 8 shows the parts.

The operating device 100 comprises a bracket 110 screwed onto the external screw portion 16 of the branch 12 of the body, and a shaft 120 is slidably supported to the bracket 110 by a mounting member 130. The front end 120a of the shaft 120 is fit to the groove 56 formed on the poppet.

A link 140 is mounted to the back end of the shaft 120, and the link 140 connects the shaft 120 to a rod member 160 used for operation. The rod member 160 is positioned between the link 140 and is clamped by a wing screw 150.

When the rod member 160 is driven vertically along the direction of arrow A, the shaft 120 raises or lowers the poppet 50 against the plug 32, thereby opening and closing the drain valve.

The support member 130 that supports the shaft 120 to the bracket 110 is made of an elastic material such as rubber. A ring groove 122 is formed to the shaft 120, and an E-ring 136 that fits to this ring groove 122 is mounted to the shaft 120. Two washers 132 and 134 are mounted on the shaft with the E-ring 136 in between. By fitting the E-ring 136 to the ring groove 122 of the shaft 120 and by inserting the support member 130 to the inner radius portion of the bracket 110, the shaft 120 is movably supported to the bracket 110.

Figure 9A:
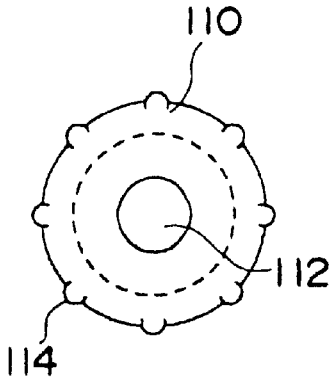
FIG. 9 is an explanatory view of the bracket of the operating device.
Figure 9B:
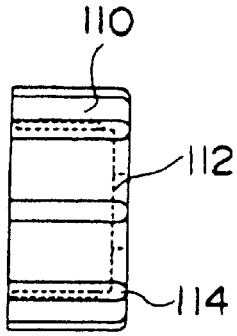
Figure 9C:
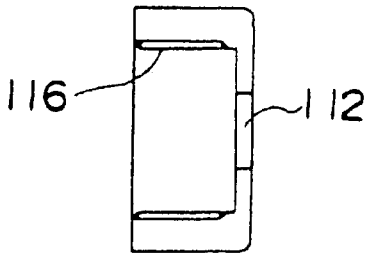

FIG. 9 is an explanatory view showing the details of the bracket 110.

The bracket 110 is formed for example of synthetic resin, and an axial protrusion 114 is formed to the exterior thereof. The protrusion 114 is used for screwing the bracket 110 onto the external screw portion 16 of the branch of the body using the inner screw portion 116. A penetrating hole 112 is formed in the center area of the bracket 110, and the shaft 120 is penetrated therethrough. A clearance exists between the shaft 120 and the penetrating hole 112, but the washer 134 forms a seal.

Figure 10A:
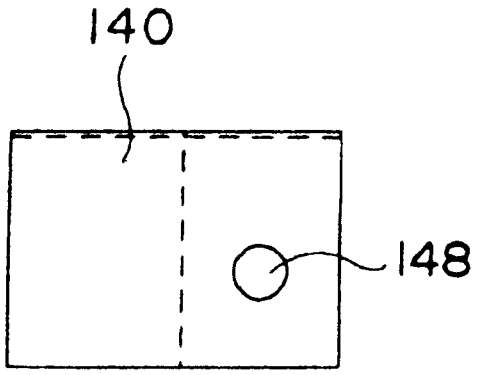
FIG. 10 is an explanatory view showing the link member of the operating device.
Figure 10B:
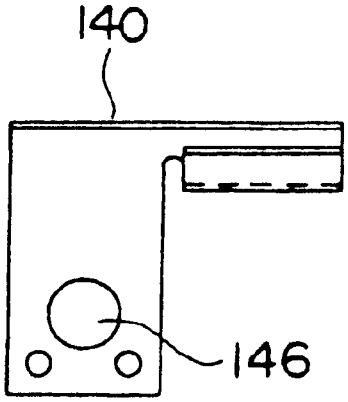
Figure 10C:
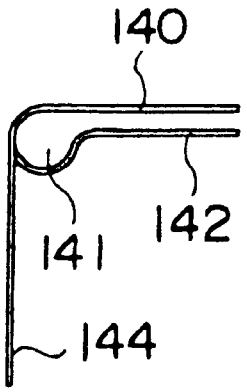

FIG. 10 is an explanatory view showing the details of the link 140.

The link 140 is formed by bending a plate material, by which a space 141 is formed where the operating rod member is to be inserted. A hole 146 formed to a portion of the link 140 fits to the back end portion of the shaft 120, and a wing screw is screwed onto a screw hole 148.

The drain valve 1 according to the present invention is equipped for the purpose of draining water for example from a bowl of a washbasin equipped in the lavatory unit on an aircraft. The washbasin of an aircraft has minimized size to save space, and the bowl of the washbasin is also miniaturized. The lever and the like for operating the drain valve is mounted on the upper surface of the bowl, which is connected to the link 140 of the operating device of the drain valve through an operating rod member 160.

FIG. 14 shows an embodiment of the present invention attached to a common wash basin, the details of which are readily identified. In this figure, the wash basin 165 is provided as is commonly found in airline lavatories. The drain valve 1 is located at the bottom of the wash basin 165 in order to drain water in the wash basin 165. In this embodiment, lever 170 is located above the wash basin 165, however, it may be connected directly to the wash basin 165. The lever 170 is connected to the link 140 through the rod member 160.

In order to synchronize the operation of the lever and the operation of the drain valve, the adjustment and attachment of the operating rod member 160 is performed last.

A feed pipe, a drain pipe and the like are equipped in the interior of the washbasin on an aircraft, and there is little space for adjusting and fixing the operating wire. However, since the present invention utilizes a wing screw as fixing means, there is no need for tools when fixing the member to position, and the operability is improved.

Figure 11:
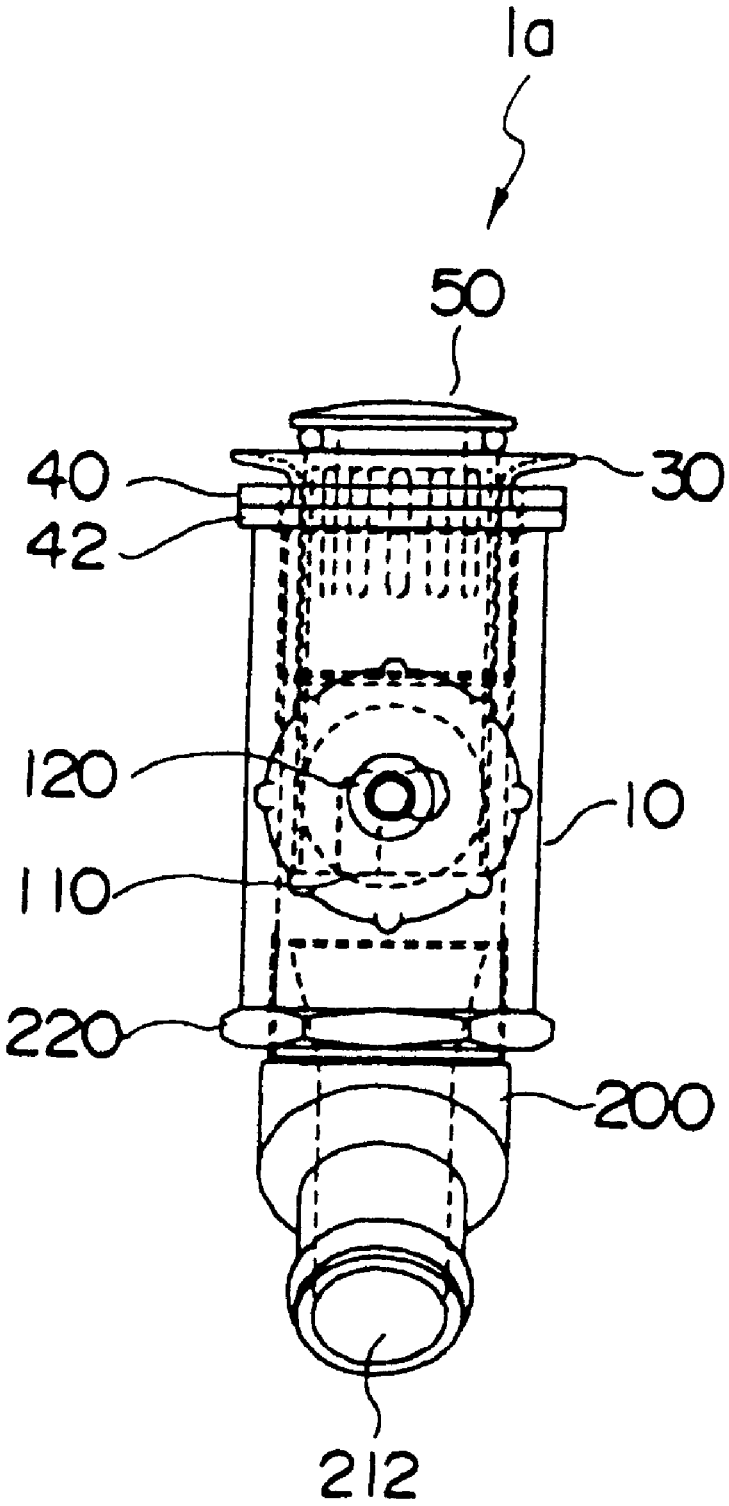
FIG. 11 is a side view showing another embodiment of the drain valve according to the present invention.
Figure 12:
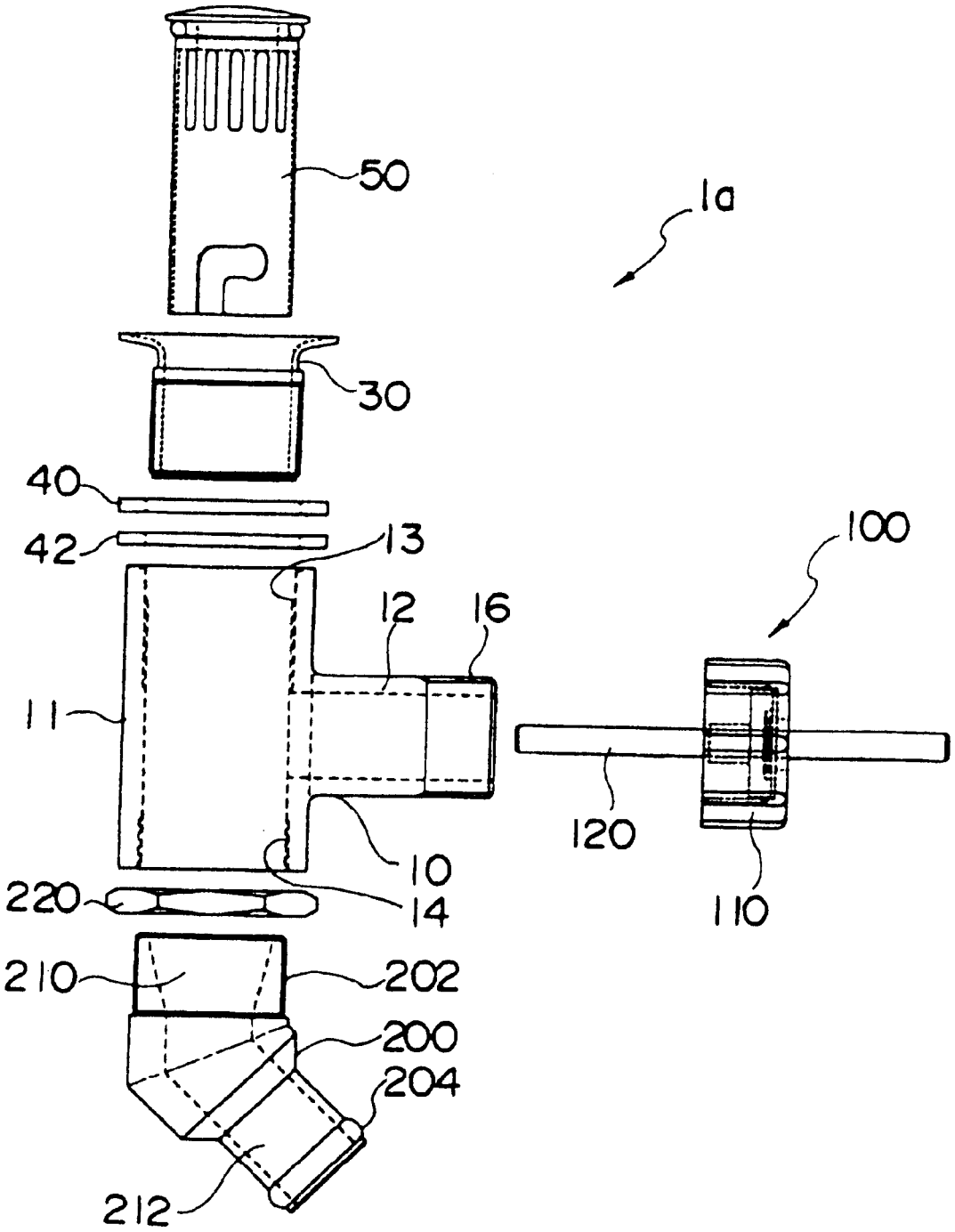
FIG. 12 shows the parts of the drain valve according to the other embodiment of the present invention.
Figure 13A:
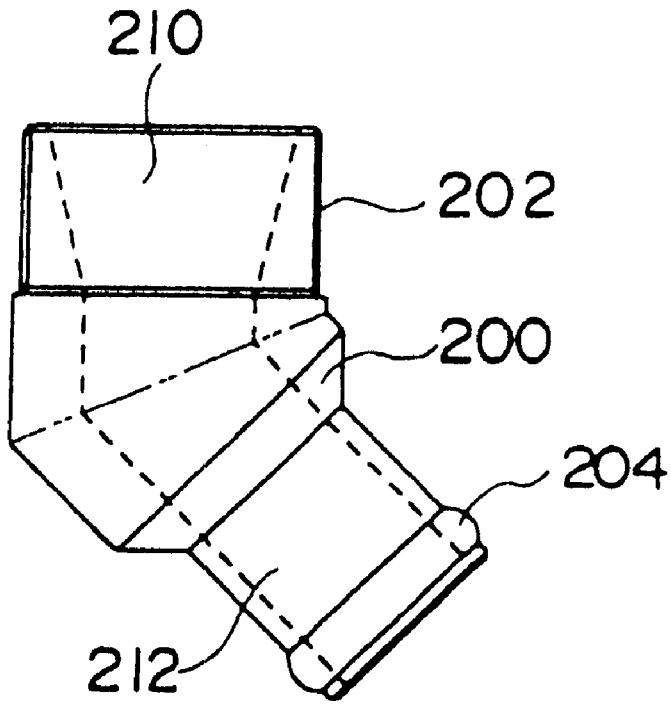
FIG. 13 is an explanatory view of the hose joint according to the other embodiment of the present invention.
Figure 13B:
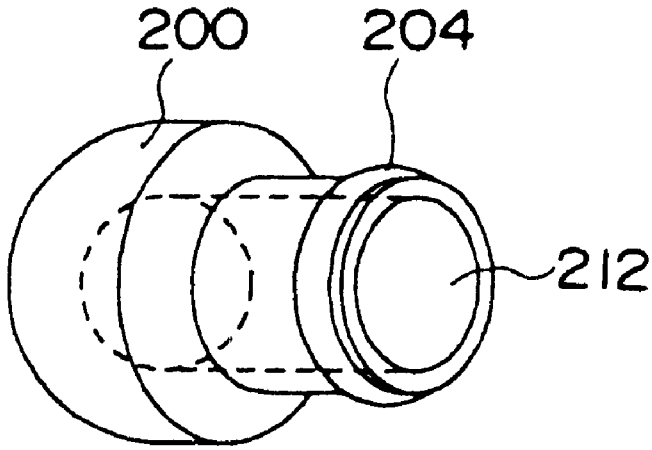

FIGS. 11, 12 and 13 are explanatory views showing another embodiment of the present invention.

The drain valve shown as a whole by reference number 1*a* comprises a body 10, and the body 10 includes a cylinder portion 11 and a branch portion 12 formed orthogonal to the cylinder portion 11. A plug 30 working as a valve seat is screwed onto a first inner screw portion 13 of the cylinder portion 11 via packings 40 and 42. A poppet 50 acting as a valve means is slidably inserted to the plug 30.

The operating device 100 mounted to the branch portion 12 of the body 10 comprises a similar structure as the previous embodiment.

As shown in FIG. 13, a hose joint member 200 includes an external screw portion 202, which is screwed onto a second inner screw portion 14 of the cylinder portion 11 of the body 10. The flow path of the hose joint member 200 is bent at the interior against the entrance 210, and is communicated to a drainage exit 212. A protrusion 204 is formed to the exterior of the exit 212, which enables the joint to be fixed securely to the hose.

A lock nut 220 is screwed onto the external screw portion 202 of the hose joint member 200. The lock nut 220 restrains the direction to which the drainage exit 212 of the hose joint member 200 faces.

According to the present embodiment, the drain valve comprises a bent drainage opening, and the direction to which the drainage exit opens can be adjusted using the lock nut. Therefore, the degree of freedom of the structure to connect the drain valve to the drainage hose is increased.

As explained above, the drain valve according to the present invention mounted to the bowl of a washbasin has a simplified structure, which facilitates the assembly and maintenance processes. The present drain valve is therefore especially suited for use in a lavatory unit and the like of an aircraft. In the washbasin equipped in an aircraft, negative pressure is applied to the drain pipe of the drain valve. Therefore, it is necessary to open the valve resisting to this negative pressure.

Since the present drain valve has good sealing performance and advanced operability, it is most appropriate to be applied to the washbasin of an aircraft.

I claim:

1. A drain valve mounted to the bottom area of a bowl in a washbasin, said drain valve comprising:

a body having a cylinder portion and a branch portion arranged orthogonal to said cylinder portion;

a plug mounted to one end of said cylinder portion of said body and constituting a valve seat;

a poppet slidably inserted to said plug and constituting a valve means;

a hose joint mounted to the other end of said cylinder portion of said body; and an operating device mounted to said branch portion of said body for operating said poppet, wherein said operating device of the poppet constituting the valve means comprises a bracket fixed to said branch portion of said body, a shaft penetrated through said bracket and movably supported by said bracket, and a link member mounted to one end of said shaft, wherein a rod member fixed to said link member by a wing screw is connected to an operating means equipped to the washbasin, and the other end of said shaft is connected to said groove of said poppet.

2. A drain valve according to claim 1, wherein both ends of said cylinder portion of said body are equipped with an inner screw portion, to which said plug and said hose joint are screwed on.

3. A drain valve according to claim 1, wherein said poppet constituting the valve means has a pipe-like structure with one end being opened, comprising a valve portion formed to the end not being opened, a plural number of slits formed to the pipe portion, and a fixing groove formed to the opened end thereof to which is connected said operating device.

4. A drain valve according to claim 1, wherein said operating device of the poppet constituting the valve means comprises a bracket fixed to said branch portion of said body, a shaft penetrated through said bracket and movably supported by said bracket, and a link member mounted to one end of said shaft, wherein a rod member fixed to said link member is connected to an operating means equipped to the washbasin, and the other end of said shaft is connected to said groove of said poppet.

5. A drain valve according to claim, 1, wherein said operating device of the poppet constituting the valve means comprises a bracket fixed to said branch portion of said body, a shaft penetrated through said bracket and movably supported by a flexible material to said bracket, and a link member mounted to one end of said shaft, wherein a rod member fixed to said link member is connected to an operating means equipped to the washbasin, and the other end of said shaft is connected to said groove of said poppet.

6. A drain valve according to claim 1, wherein said hose joint mounted to said cylinder portion of said body comprises an external screw portion screwed onto an inner screw portion of said cylinder, and an outward protrusion that secures the connection between a hose, said hose joint forming an axis with the drainage opening that corresponds to the axis of said cylinder of said body.

7. A drain valve according to claim 1, wherein said hose joint mounted to said cylinder portion of said body comprises an external screw portion screwed onto an inner screw portion of said cylinder, and an outward protrusion that secures the connection between a hose, said hose joint forming an axis with the drainage opening that is bent against the axis of said cylinder of said body.

8. A drain valve according to claim 1, wherein negative pressure is applied through the opening of said hose joint.

* * * * *